US011691063B2

(12) United States Patent
Luigi

(10) Patent No.: US 11,691,063 B2
(45) Date of Patent: Jul. 4, 2023

(54) BOXING OR SPARRING DEVICE THAT FIGHTS BACK

(71) Applicant: CORSAN INVENTIONS CORP., Aguadilla, PR (US)

(72) Inventor: Giancarlo Luigi, Aguadilla, PR (US)

( * ) Notice: Subject to any disclaimer, the term of this patent is extended or adjusted under 35 U.S.C. 154(b) by 0 days.

(21) Appl. No.: 17/460,903

(22) Filed: Aug. 30, 2021

(65) Prior Publication Data

US 2023/0067901 A1 Mar. 2, 2023

(51) Int. Cl.

| | |
|---|---|
| ***A63B 69/34*** | (2006.01) |
| ***A63B 69/00*** | (2006.01) |
| ***A63B 69/22*** | (2006.01) |

(52) U.S. Cl.

CPC ..... *A63B 69/34* (2013.01); *A63B 69/004* (2013.01); *A63B 69/224* (2022.08)

(58) Field of Classification Search

CPC ..... A63B 69/208; A63B 69/24; A63B 69/34; A63B 69/206; A63B 69/203; A63B 69/20; A63B 69/22; A63B 69/224; A63B 69/004

See application file for complete search history.

(56) References Cited

U.S. PATENT DOCUMENTS

| | | | | | |
|---|---|---|---|---|---|
| 4,721,302 | A * | 1/1988 | Murphy | A63B 69/0053 | 482/901 |
| 5,046,724 | A * | 9/1991 | Sotomayer | A63B 69/20 | 482/90 |
| 5,352,170 | A * | 10/1994 | Condo | A63B 69/201 | 482/83 |
| 5,554,088 | A * | 9/1996 | Zlojutro | A63B 71/023 | 482/89 |
| 5,700,230 | A * | 12/1997 | Cardona | A63B 69/34 | 482/90 |
| 6,155,960 | A * | 12/2000 | Roberts | A63B 69/34 | 482/90 |
| 6,398,697 | B1 * | 6/2002 | Nichols, Jr. | A63B 69/20 | 473/441 |
| 10,639,535 | B2 * | 5/2020 | Hoover | A63B 69/004 | |
| 2010/0179031 | A1 * | 7/2010 | Luigi | A63B 69/34 | 482/148 |
| 2021/0283482 | A1 * | 9/2021 | Wu | A63B 71/023 | |

FOREIGN PATENT DOCUMENTS

| | | | | |
|---|---|---|---|---|
| WO | WO-2014041371 A1 * | 3/2014 | ..... | A63B 69/004 |

* cited by examiner

*Primary Examiner* — Sundhara M Ganesan
*Assistant Examiner* — Jacqueline N L Loberiza
(74) *Attorney, Agent, or Firm* — Eugenio J. Torres-Oyola; Victor M. Rodriguez-Reyes; Rafael Rodriguez-Muriel

(57) ABSTRACT

A boxing or sparring device that fights back that includes one or more boxing bags, one or more boxing arms and alternatively a kicking leg.

7 Claims, 10 Drawing Sheets

BOXING OR SPARRING DEVICE THAT FIGHTS BACK

STATEMENT REGARDING FEDERALLY SPONSORED RESEARCH AND DEVELOPMENT

N/A

RELATED APPLICATIONS

N/A

BACKGROUND OF THE INVENTION

1. Technical Field

The invention relates generally to boxing or sparring devices that fight back, thereby acting as a sparring partner that swings its own arms and legs in response to the user's punches.

2. Background Information

Boxing is not only a sport, but an aerobic exercise too. There are various devices in the prior art that teach or train a person in certain specific aspects of boxing. Some devices in the prior art disclose arm-like structures which may swing at an attacker in response to a blow. For instance, U.S. Pat. No. 4,434,980 to Babineaux discloses a device that fights back comprising a boxing bag and a pair of arms. However, Babineaux does not simulate actual fighting conditions as the arms swing forward in predictable motions.

Therefore, it can be appreciated that there exists a continuing need for a new and improved training device in the prior art that can train all aspects of boxing and kickboxing in one training session. In this regard, the present invention substantially fulfills this need.

SUMMARY OF THE INVENTION

The invention relates to a boxing or sparring device that fights back. In particular, a first embodiment of the invention relates to a free-standing sparring device comprising a base, a first rod, a second rod, a third rod, a fourth rod, a high-tension spring, one or more boxing bags, first and second fixation screws, one or more boxing arms and alternatively a kicking leg. A second embodiment of the invention relates to a sparring device that is attached to both the floor and the ceiling. In this second embodiment, the sparring device comprises a main rod having a first end and a second end, wherein each end includes a first and a second attaching mechanism. The first attaching mechanism is capable of being attached to a first rubber cord or spring that is attached to a hook screw on the ceiling, whereas the second attaching mechanism is capable of being attached to a second rubber cord or spring that is attached to a hook screw on the floor.

The present disclosure may address one or more of the problems and deficiencies of the prior art discussed above. However, it is contemplated that the disclosure may prove useful in addressing other problems and deficiencies in a number of technical areas. Therefore, the claimed invention should not necessarily be construed as limited to addressing any of the particular problems or deficiencies discussed herein.

BRIEF DESCRIPTION OF THE DRAWINGS

The present invention is described with reference to the accompanying drawings.

In the drawings, like reference numbers indicate identical or functionally similar elements.

DETAILED DESCRIPTION OF THE INVENTION

Figure 1:
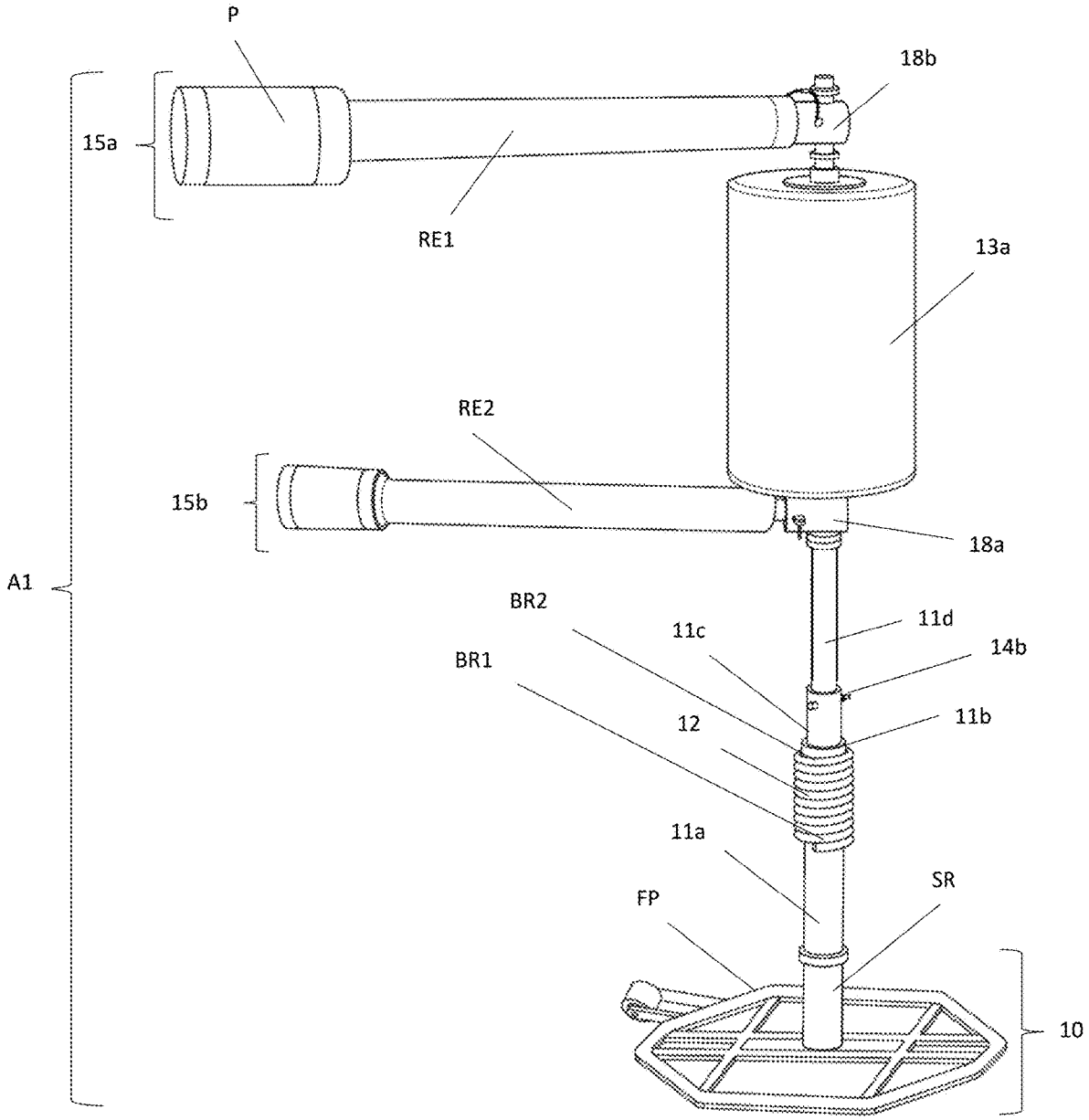
FIG. 1 shows a first embodiment of a boxing device that fights back, in accordance with principles of the present disclosure.

In the Summary above, the Description below, and in the accompanying drawings, reference is made to particular features of the present disclosure. It is to be understood that the disclosure includes possible combinations of such particular features. For example, where a particular feature is disclosed in the context of a particular aspect or exemplary embodiment, or a particular claim, that feature can also be used, to the extent possible, in combination with and/or in the context of other particular aspects and exemplary embodiments, and in the invention generally.

The term "comprises", and grammatical equivalents thereof are used herein to mean that other components, structures, steps, etc. are optionally present. For example, an article "comprising" (or "which comprises") components A, B, and C can consist of (i.e., contain only) components A, B, and C, or can contain not only components A, B, and C, but also one or more other components or structures.

The term "at least" followed by a number is used herein to denote the start of a range beginning with that number (which may be a range having an upper limit or no upper limit, depending on the variable being defined). For example, "at least 1" means 1 and/or more than 1.

While the specification will conclude defining the features of exemplary embodiments of the disclosure that are regarded as novel, it is believed that the disclosure will be better understood from a consideration of the following description in conjunction with the figures, in which like reference numerals are carried forward.

Figure 2:
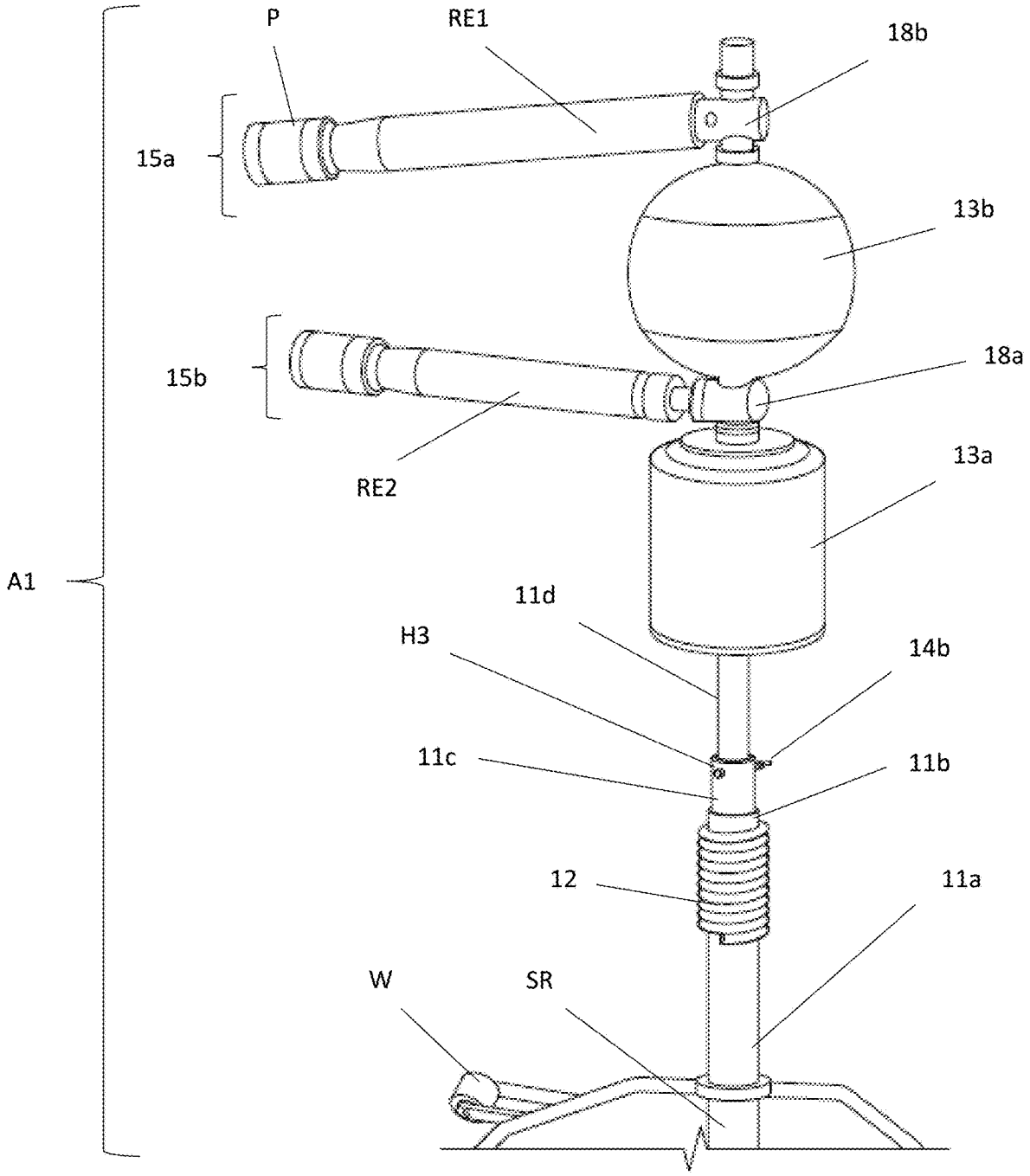
FIG. 2 shows an alternate version of the first embodiment of the boxing device that fights back, in accordance with principles of the present disclosure.
Figure 3:
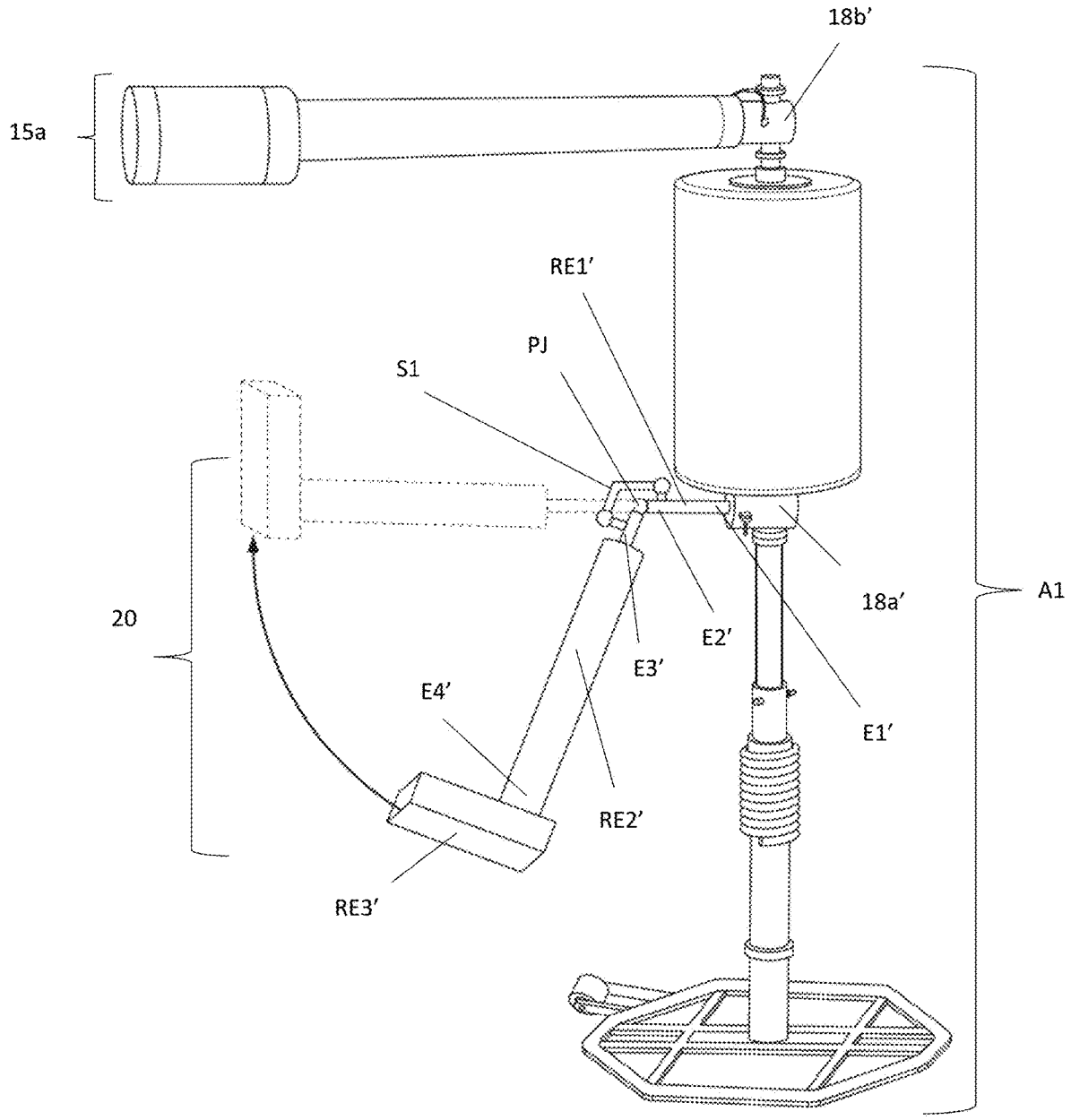
FIG. 3 shows an alternate version of the first embodiment of the boxing device that fights back, in accordance with principles of the present disclosure.

FIGS. 1-3 relate to a first embodiment of the boxing or sparring device that fights back. In particular, the first embodiment relates to a free-standing sparring device A1 comprising a base 10, a first rod 11*a*, a second rod 11*b*, a third rod 11*c*, a fourth rod 11*d*, a high-tension spring 12, one or more boxing bags 13*a*, 13*b*, first and second fixation screws 14*a*, 14*b*, and one or more boxing arms 15*a*, 15*b*. It should be noted that the base and rods 11*a*-11*d* can be manufactured from any metal alloy, such as aluminum, iron, or the like. Alternatively, it may be manufactured from plastic or any similar strong and durable material. It should also be noted that the rods 11*a*-11*d* are hollow to allow for the insertion of one rod into the next rod, as further explained below.

The base 10 preferably includes a substantially flat portion FP and a supporting receptacle SR with an opening configured to receive a first end FR1 of the first rod 11*a*. The substantially flat portion FP of the base 10 may include one or more holes configured to receive fasteners or screws to anchor the base 10 to the floor. Alternatively, the base 10 may be anchored to the floor with weights and/or sand bags whose weight provides stability to the base 10 when the sparring device A1 is in use. The base 10 may include one or more wheels W to facilitate transportation of the sparring device A1 from one spot to another. Moreover, the supporting receptacle SR (one end thereof) is perpendicularly welded or attached to the center of the flat portion FP in order to maintain or preserve the stability of the free-standing sparring device. It should also be noted that the first end FR1 of the first rod 11*a* is configured to be inserted into the supporting receptacle SR; and once inserted, the first end FR1 of the first rod 11*a* is secured to the supporting receptacle SR via the first fixation screw 14*a*, which radially crosses the first rod 11*a*. The supporting receptacle SR should preferably have a diameter or width that is larger than the diameter or width of the first rod 11*a* in order to facilitate insertion of the first rod 11*a* into the supporting receptacle SR. Since it has a smaller diameter than the supporting receptacle SR, the first rod 11*a* is capable of sliding up and down the supporting receptacle SR, thereby allowing a user to adjust the height of free-standing sparring device A1. The first rod 11*a* includes one or more holes H, one on top of the other that are configured to receive the first fixation screw 14*a*. The supporting receptacle SR, in turn, includes at least one hole H2 that is configured to receive the first fixation screw 14*a*. As the first rod 11*a* is raised or lowered in the supporting receptacle SR, one of the holes H in the first rod 11*a* will match with the hole H2 in the supporting receptacle SR and the user may introduce the first fixation screw 14*a* to fix the free-standing sparring device A1 at the desired height. Accordingly, placement of the first fixation screw 14*a* in one of the holes H on the first rod with and the corresponding hole H2 on the supporting receptacle SR, facilitates adjustment of the height of the free-standing sparring device A1. Alternatively, the first rod 11*a* may be secured to the supporting receptacle SR via a fixation clamp FC; or welded to the supporting receptacle SR, so that the first rod 11*a* is tightly secured therein.

Figure 4:
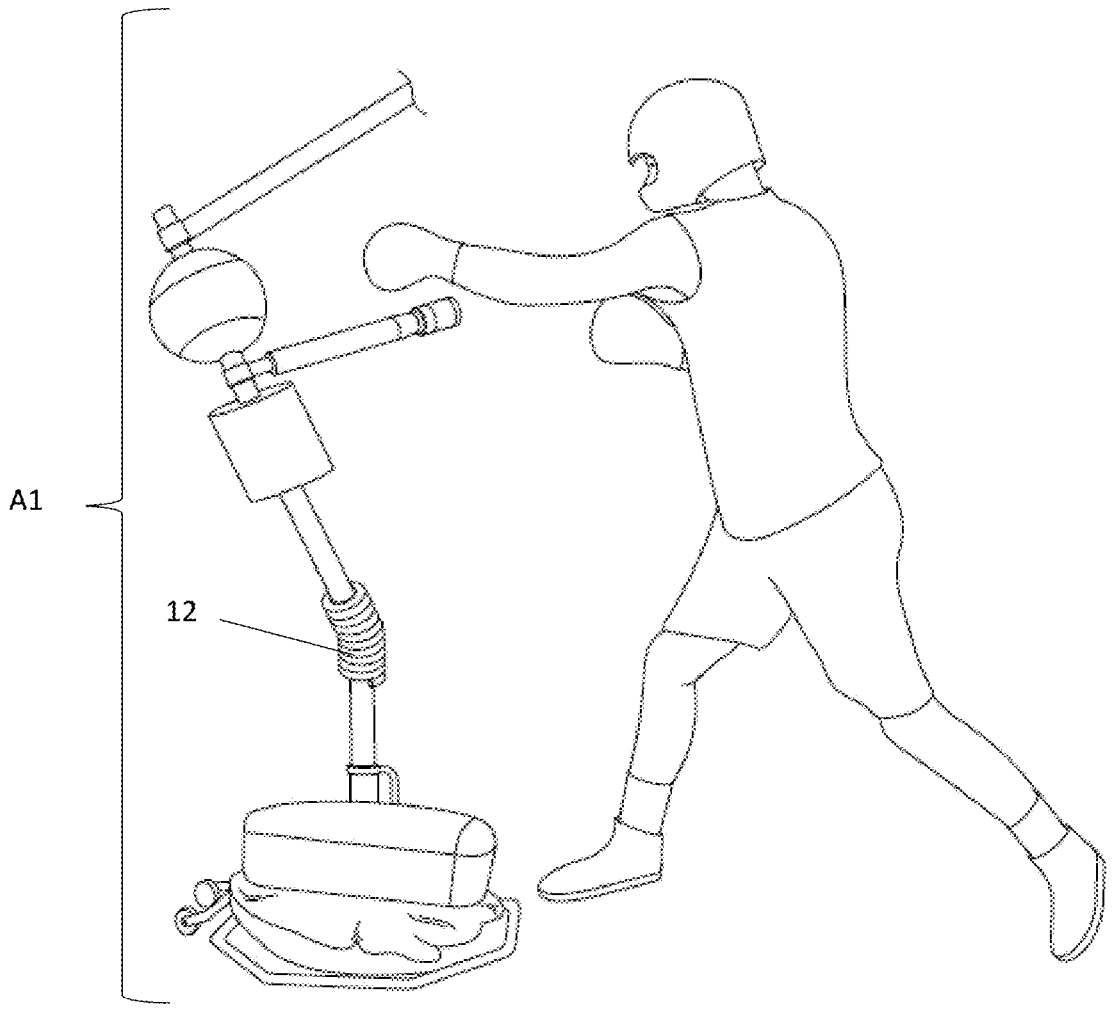
FIG. 4 shows a user punching the first embodiment of the boxing device that fights back, in accordance with principles of the present disclosure.
Figure 6:
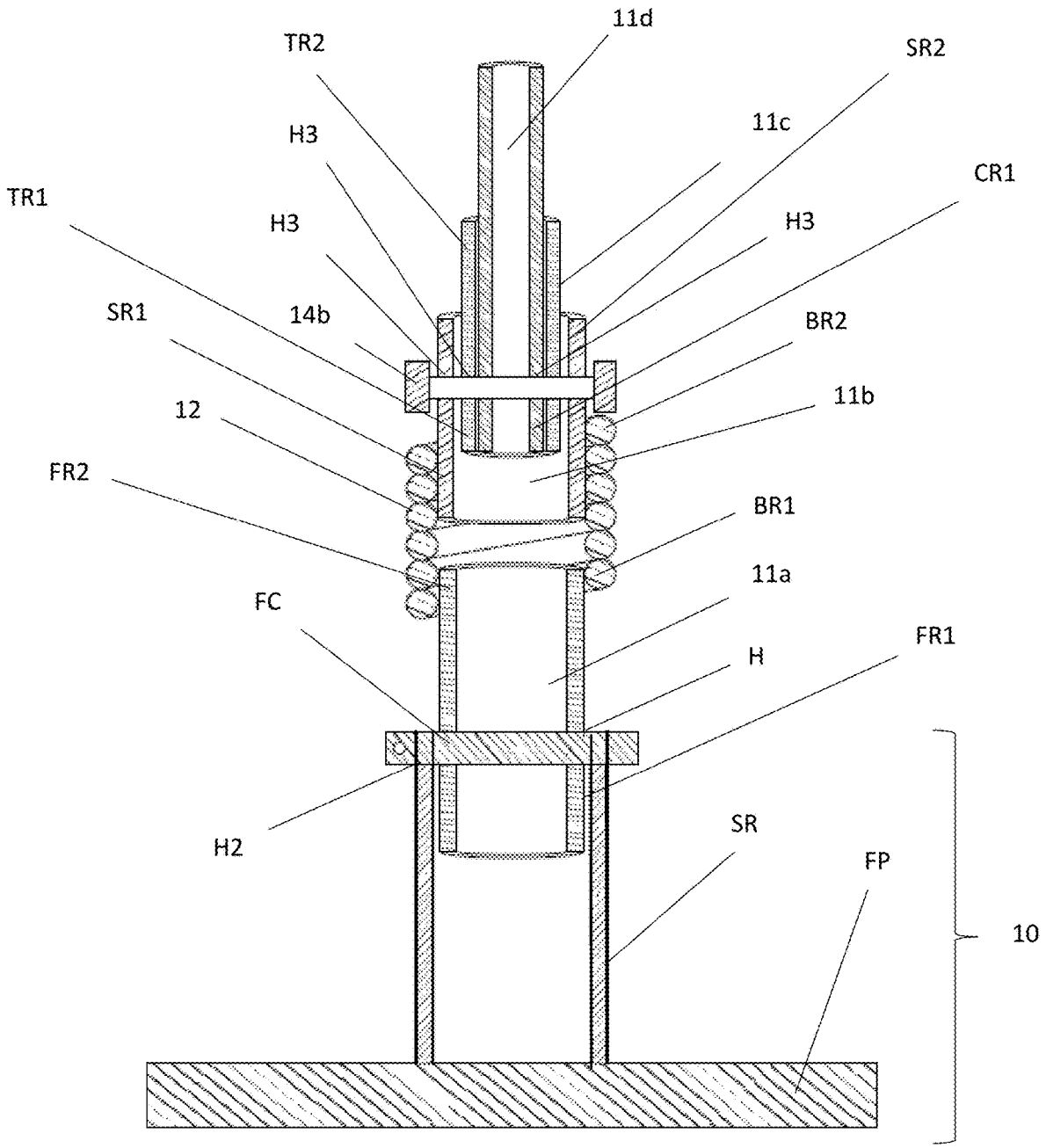
FIG. 6 shows a cross section of the spring used in the first embodiment of the boxing device that fights back, in accordance with principles of the present disclosure.

As shown in FIG. 6, a second end FR2 of the first rod 11*a*, in turn, is inserted into a first end BR1 of the high-tension spring 12 and welded or attached therein. Similarly, a first end SR1 of the second rod 11*b* is inserted into a second end BR2 of the high-tension spring 12 and welded or attached therein. The high-tension spring 12 should have a diameter or width that is larger than the diameter or width of the first and second rods 11*a*, 11*b* in order to facilitate insertion of these rods 11*a*, 11*b* into the high-tension spring 12. The spring 12 should preferably have a width of 3 inches and a length of 6 inches. These measurements will provide optimal bending of the free-standing sparring device A1 when the one or more boxing bags 13*a*, 13*b* are hit or punched by a user, as shown in FIG. 4.

A first end TR1 of the third rod 11*c*, in turn, is inserted into a second end SR2 of the second rod 11*b*, as shown in FIG. 6. The second rod 11*b* should have a diameter or width that is larger than the diameter or width of the third rod 11*c* in order to facilitate insertion of the third rod 11*c* into the second rod 11*b*. Lastly, a first end CR1 of the fourth rod 11*d* is inserted into a second end TR2 of the third rod 11*c*, as shown in FIG. 6. The third rod 11*c* should have a diameter or width that is larger than the diameter or width of the fourth rod 11*d* in order to facilitate insertion of the fourth rod 11*d* into the third rod 11*c*. Once inserted, the third and fourth rods 11*c*, 11*d* are secured to the second rod 11*b* via the second fixation screw 14*b* that radially crosses the second, third and fourth rods 11*b*-11*d*, as shown in FIG. 6. The second, third and fourth rods 11*b*-11*d* include one or more holes H3 configured to receive the second fixation screw 14*b*.

Boxing arm 15*a* comprises a rigid extension RE1 that is attached to the fourth rod 11*d* via a ball bearing 18*a*. Similarly, boxing arm 15*b* comprises a rigid extension RE2 that is attached to the fourth rod 11*d* via a ball bearing 18*b*. Ball bearings 18*a*, 18*b* allow the boxing arms to move around the fourth rod 11*d*, which serves as an axis or pivot point to the one or more boxing arms 15*a*, 15*b*. As such, when the boxing arms are hit or punched by a user, they spin or rotate around the axis crated by the fourth rod 11*d*. The boxing arms 15*a*, 15*b* may be covered by padding P (e.g., foam) that surrounds the rigid extensions RE1, RE2 of the corresponding boxing arm 15*a*, 15*b*, thereby softening any blows to the user. Moreover, the rigid extensions RE1, RE2 of the boxing arms 15*a*, 15*b* can be manufactured form plastic, aluminum or any other similar material that is lightweight, solid and durable.

Figure 7:
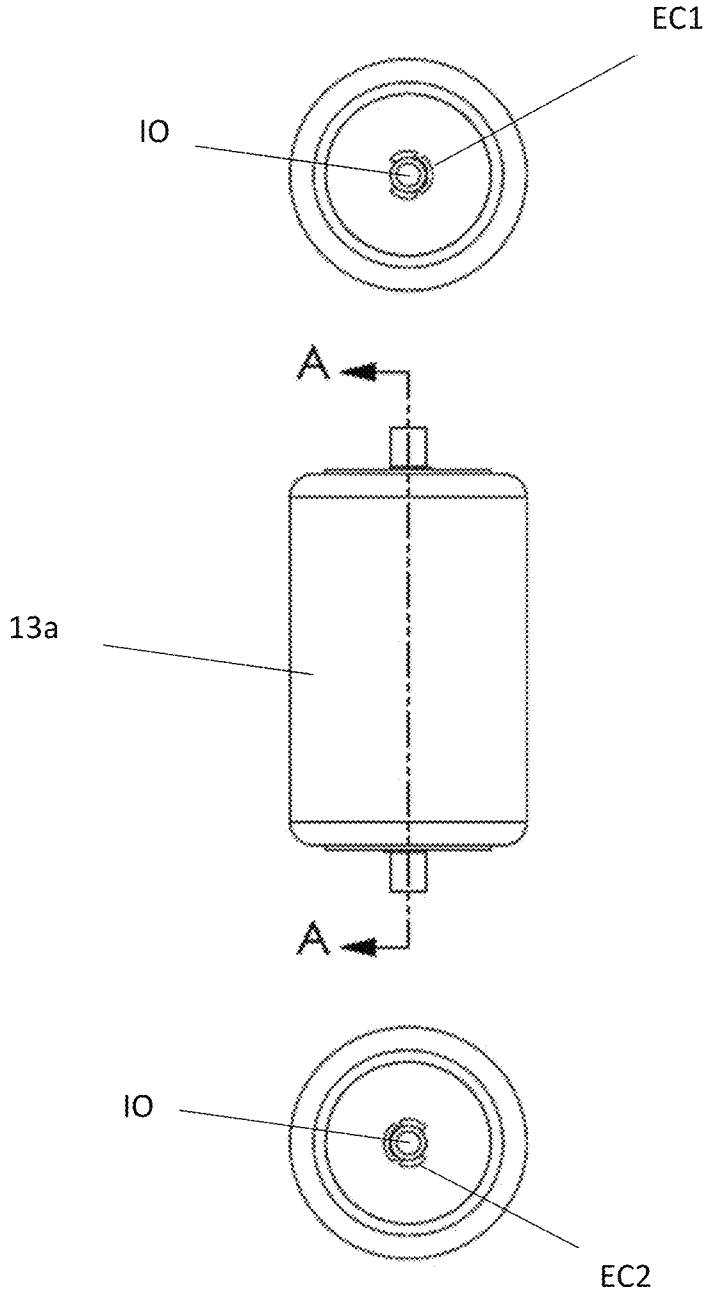
FIG. 7 shows the components of punching bag used in either embodiment of the boxing device that fights back, in accordance with principles of the present disclosure.
Figure 8A:
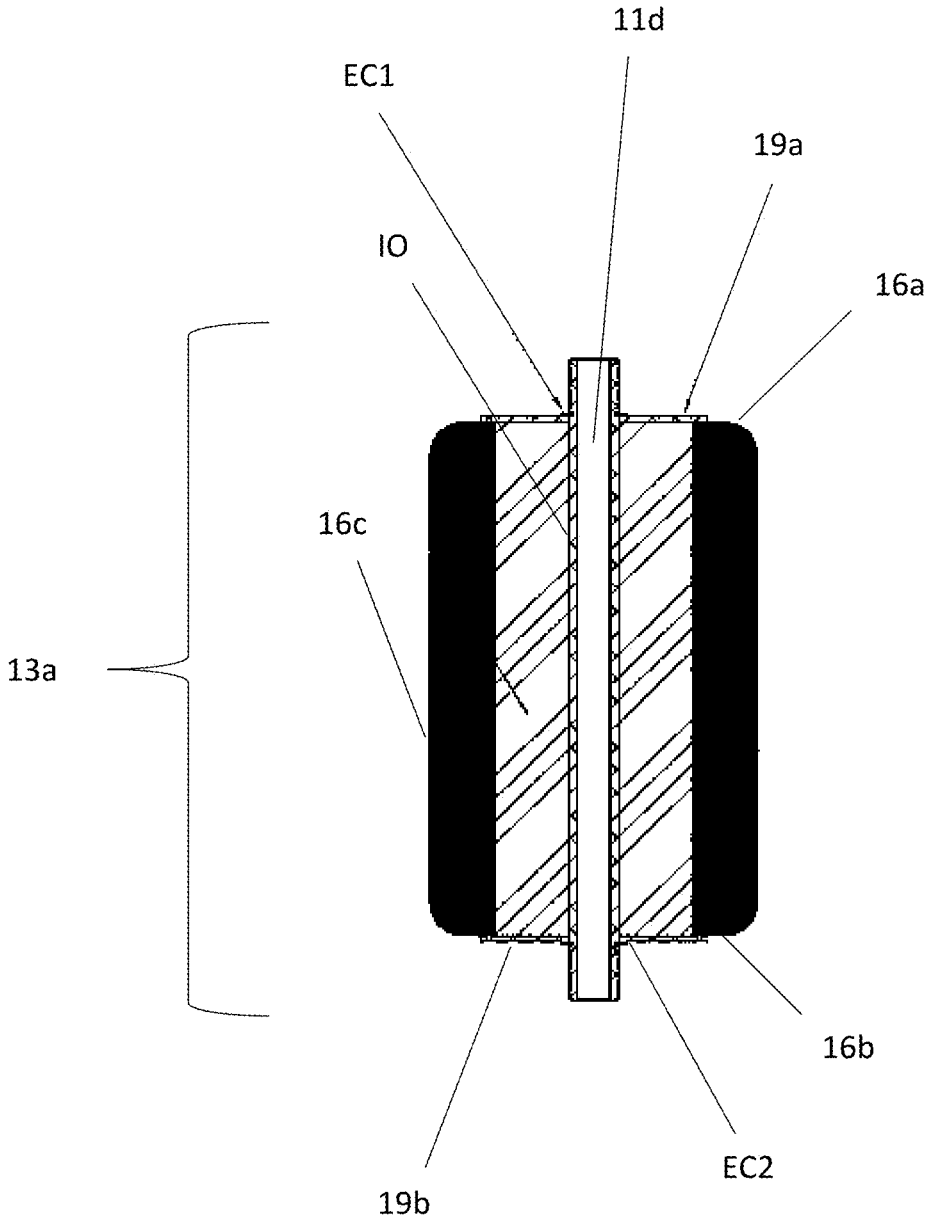
FIGS. 8A-8B shows a cross section of the punching bag used in either embodiment of the boxing device that fights back, in accordance with principles of the present disclosure.
Figure 9:
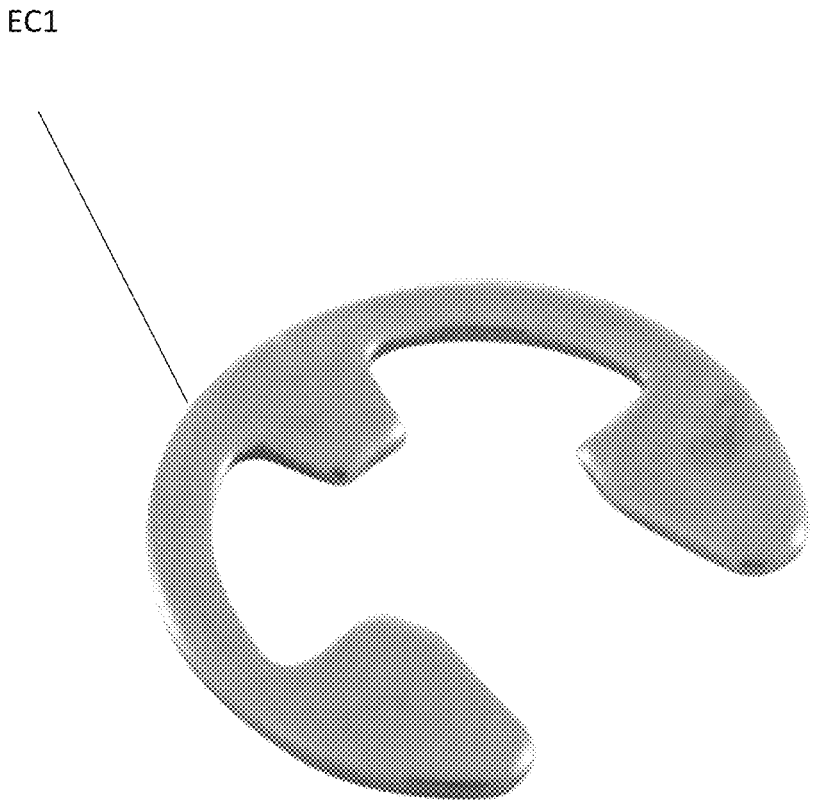
FIG. 9 shows an E-clip type retaining ring used to secure the boxing bags to either embodiment of the boxing device that fights back, in accordance with principles of the present disclosure.

As shown in FIGS. 7 and 8A, boxing bags 13*a*, 13*b* comprise a top end 16*a*, a bottom end 16*b*, and a body 16*c*. Boxing bags 13*a*, 13*b* further comprise an internal opening 10 that can be accessed from the top and bottom ends 16*a*, 16*b*, thereby allowing the corresponding boxing bag 13*a*, 13*b* to be installed on the fourth rod 11*d*. Accordingly the internal opening 10 radially crosses the corresponding boxing bag 13*a*, 13*b* from top end 16*a* to bottom end 16*b*. The internal opening 10 surrounds at least a portion of the fourth rod 11*d* and has a diameter that is sufficient for the fourth rod 11*d* to fit. Once installed on the fourth rod 11*d*, the boxing bags 13*a*, 13*b* are secured to therein via a combination of first and second mounting plates 19*a*, 19*b* and first and second E-clip type retaining rings EC1, EC2. The purpose of the mounting plates 19*a*, 19*b* is to squeeze and provide stability to the corresponding boxing bags 13*a*, 13*b*, whereas the purpose of the retaining rings EC1, EC2 is to hold and secure the mounting plates 19*a*, 19*b* and boxing bags 13*a*, 13*b* to the fourth rod 11*d*. The retaining rings EC1, EC2 can be appreciated in FIG. 9. The boxing bags 13*a*, 13*b* can be manufactured via foam injection molding and configured to the desired shape. As such, the shape of the boxing bags 13*a*, 13*b* can be rounded, squared or any other desired shape, as shown in FIG. 2.

The free-standing sparring device A1 may alternatively include at least one kicking leg 20, in place of or in addition to the boxing arms 15*a* or 15*b*, as shown in FIG. 3. The kicking leg 20 comprises a first rigid extension RE1' having a first end E1' that is attached to either the third or fourth rods 11*c*, 11 *d* via a ball bearing 18*a*' or 18*b*'. A second end E2' of the first rigid extension RE1', in turn, is attached via a pivot joint PJ to a first end E3' of the second rigid extension RE2'. The first rigid extension RE1' may be further attached to the first end E3' of the second rigid extension RE2' via a spring S1. Lastly, a second end E4' of the second rigid extension RE2', in turn, is perpendicularly attached to a third rigid RE3' extension, which may resemble a foot. When the free-standing sparring device A1 may is struck the kicking leg 20 will move up and down or side to side as if it were kicking a user of the free-standing sparring device A1. The user will then have a chance to either block or dodge the kick. Each of the rigid extensions RE1', RE2', RE3' may by covered by padding P' (e.g., foam) that soften blows to the user.

Figure 5:
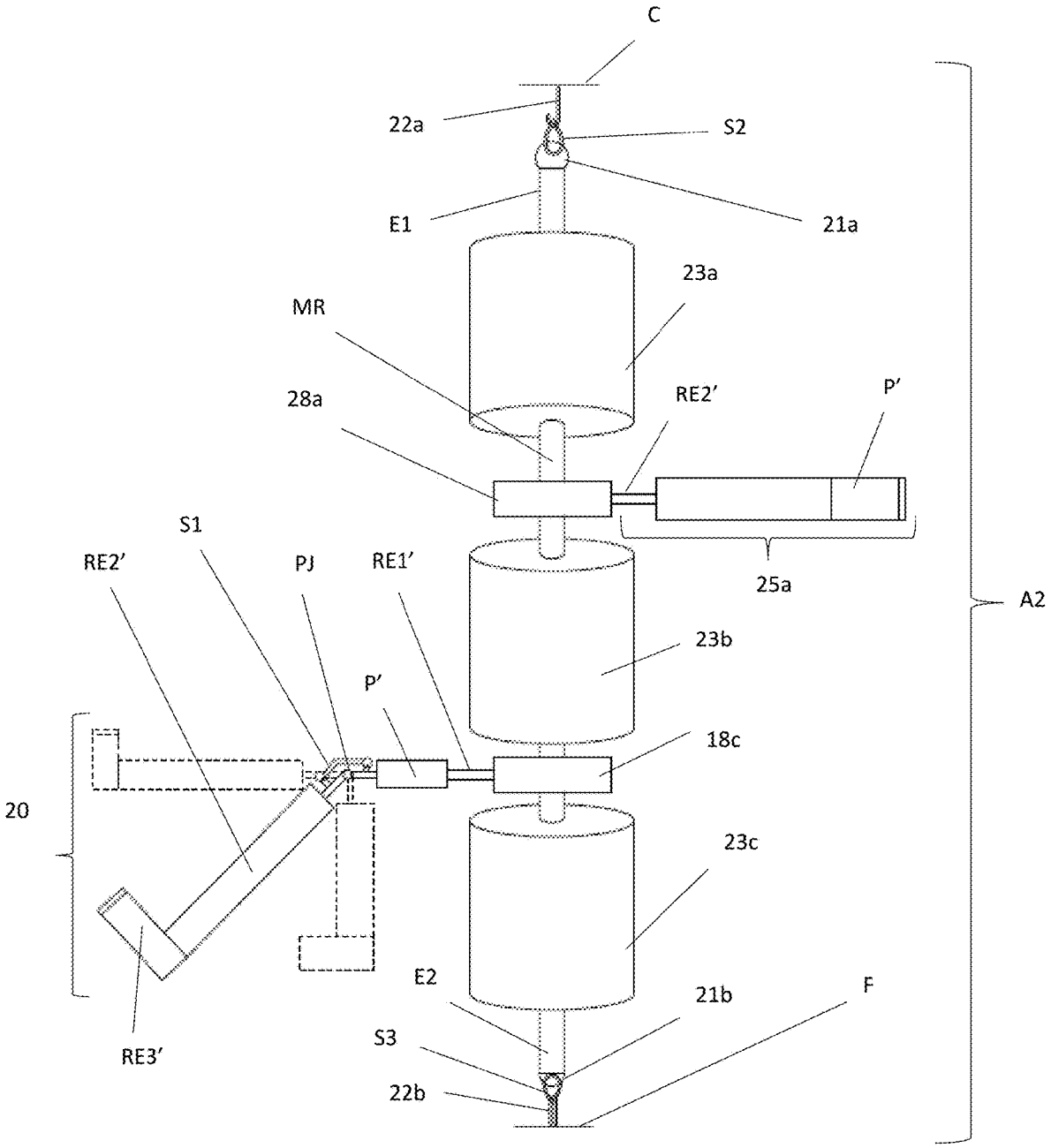
FIG. 5 shows a second embodiment of the boxing device that fights back, in accordance with principles of the present disclosure.

FIG. 5 relates to a second embodiment of the boxing device or sparring device that fights back. In particular, the second embodiment relates to a sparring device A2 that is attached to both the floor F and the ceiling C. In this embodiment, the components of the sparring device A2 appear to be hanging or suspended between the floor F and ceiling C. The sparring device A2 comprises a main rod MR having a first end E1 and a second end E2, wherein each end includes an attaching mechanism 21*a*, 21*b*, respectively, such as closed hook or carabiner. The first attaching mechanism 21*a* is capable of being attached to a first rubber cord or spring S2 that is attached to a hook screw 22*a* on the ceiling C. The second attaching mechanism 21*b*, on the other hand, is capable of being attached to a second rubber cord or spring S3 that is attached to a hook screw 22*b* on the floor F. It should be noted that the main rod MR can be manufactured from any metal alloy, such as aluminum, iron, or the like. Alternatively, it may be manufactured from plastic or any similar strong and durable material.

The sparring device A2 also comprises one or more boxing arms 25*a*. Boxing arm 25*a* comprises a rigid extension RE2' that is attached to the main rod MR via a ball bearing 28*a*. The sparring device A2 also comprises at least one kicking leg 20. The kicking leg 20 comprises a first rigid extension RE1' that is attached to the main rod MR via a ball bearing 18*c*. The first rigid extension RE1', in turn, is attached via a pivot joint PJ to a second rigid extension RE2'. FIG. 5 shows movement of the second rigid extension RE2' in relation to the pivot joint PJ. The first rigid extension RE1' may be further attached to the second rigid extension RE2' via a spring S1. Lastly, the second rigid extension RE2', in turn, is perpendicularly attached to third rigid RE3' extension, which may resemble a foot. As previously noted, each of the rigid extensions RE1', RE2', RE3' may by covered by padding P' (e.g., foam) that soften blows to the user.

Ball bearings 28*a* and 18*c* allow the boxing arm and kicking leg 20, respectively, to move around the main rod MR, which serves as an axis or pivot point to the one or more boxing arms 25*a* or kicking leg 20. As such, when the boxing arms 25*a* or kicking legs 20 are hit or punched by a user, they spin or rotate around the axis created by the main rod MR, and in the case of kicking leg 20, move up or down or side to side. The boxing arm 25*a* may include padding P' (e.g., foam) surrounding the rigid extensions RE1", thereby softening any blows to the user. Moreover, the rigid extensions RE1" of the boxing arms 25*a* can be manufactured form plastic, aluminum or any other similar material that is lightweight, solid and durable.

Figure 8B:
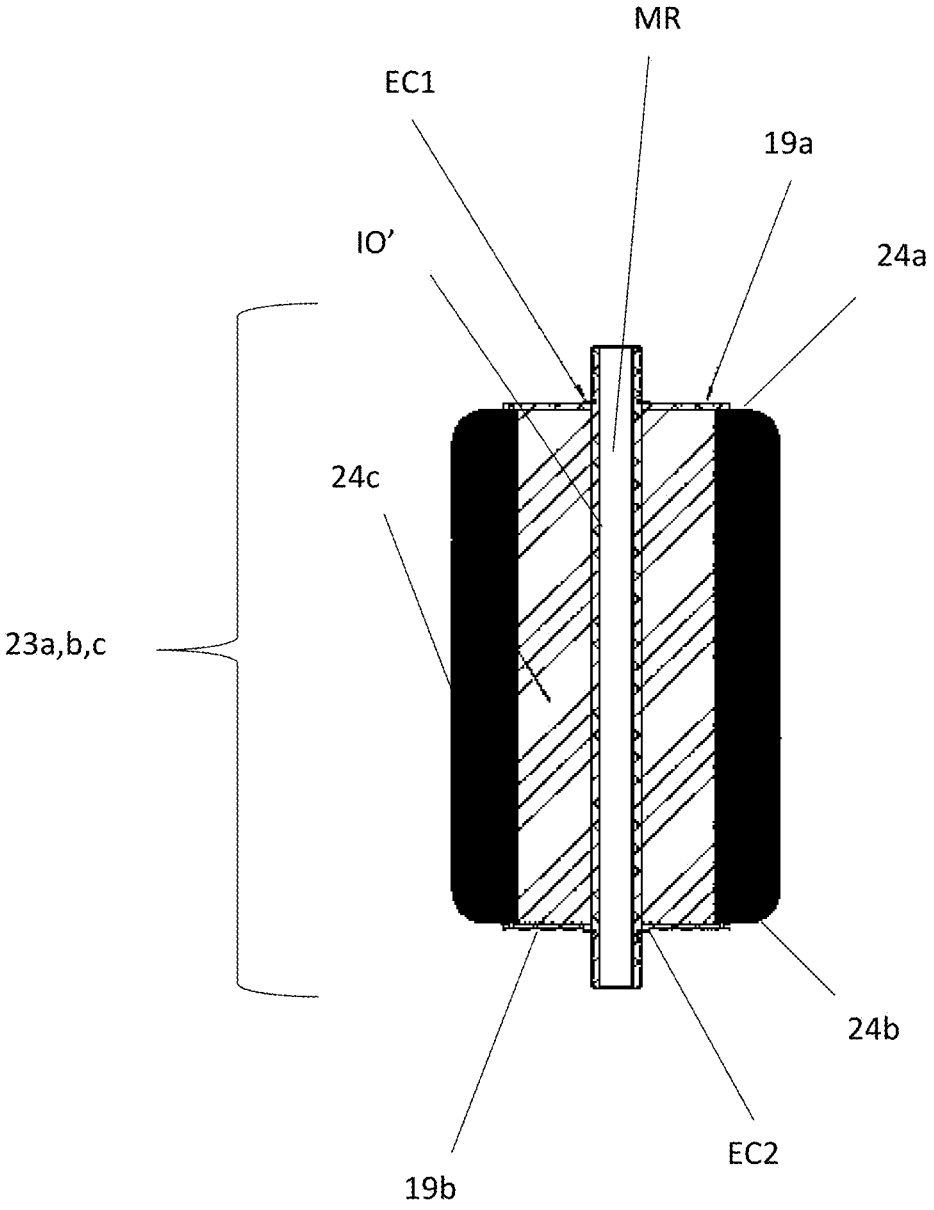

The hanging sparring device A2 further comprises one or more boxing bags 23*a*, 23*b*, 23*c*, wherein each boxing bag comprises a top end 24*a*, a bottom end 24*b*, and a body 24*c*. As shown in FIG. 8B, boxing bags 23*a*, 23*b*, 23*c* further comprise an internal opening 10' that can be accessed from the top and bottom ends 24*a*, 24*b*, thereby allowing the corresponding boxing bag 23*a*, 23*b*, 23*c* to be installed on the main rod MR. Accordingly the internal opening 10' radially crosses the corresponding boxing bag 23*a*, 23*b*, 23*c* from top end to bottom end. The internal opening 10' is configured to surround at least a portion of the main rod MR and has a diameter that is sufficient for the main rod MR to fit. Once installed on the main rod MR, the boxing bags 23*a*, 23*b*, 23*c* are secured to therein via a combination of first and second mounting plates 19*a*, 19*b*, and first and second E-clip type retaining rings EC1, EC2, as previously described for the first embodiment A1. The boxing bags 23*a*, 23*b*, 23*c* can be manufactured via foam injection molding and configured to the desired shape. As such, the shape of the boxing bags 23*a*, 23*b*, 23*c* can be rounded, squared or any other desired shape.

Because there can be the present invention and that other embodiments without departing from the spirit and scope of the invention, the present invention will be appreciated that not limited to the specific embodiment example, defined in the claims.

What is claimed is:

1. A boxing or sparring device, comprising:

a free-standing base;

a first rod, a second rod, a third rod and a fourth rod;

wherein each of the first rod, the second rod, the third rod, and the fourth rod comprises a diameter;

a first spring comprising a first end and a second end;

wherein the free-standing base comprises a flat portion and a supporting receptacle with an opening configured to receive a first end of the first rod;

wherein the supporting receptacle comprises a diameter that is larger than the diameter of the first rod;

wherein the diameter of the second rod is larger than the diameter of the third rod;

wherein the diameter of the third rod is larger than a diameter of the fourth rod;

wherein the first spring comprises a diameter that is larger than the diameter of the first rod and the diameter of the second rod;

wherein one end of the supporting receptacle is perpendicularly attached to the flat portion of the base;

wherein the first end of the first rod is secured to the supporting receptacle via a fixation clamp;

wherein a second end of the first rod is inserted into the first end of the first spring and welded therein;

wherein a first end of the second rod is inserted into the second end of the first spring and welded therein;

wherein a first end of the third rod is inserted into a second end of the second rod;

wherein a first end of the fourth rod is inserted into a second end of the third rod;

wherein the third rod and the fourth rod are secured to the second rod via a fixation screw that radially crosses the second, third and fourth rods;

at least one kicking leg comprising a first rigid extension, a second rigid extension, and a third rigid extension, wherein each of the first rigid extension, the second rigid extension, and the third rigid extension of the at least one kicking leg comprises a first end and a second end;

wherein the first end of the first rigid extension is attached to either the third rod or the fourth rod via a ball bearing;

wherein the second end of the first rigid extension is attached to the first end of the second rigid extension via a pivot joint;

wherein the second end of the first rigid extension of the at least one kicking leg is further attached to the first end of the second rigid extension via a second spring;

wherein the second end of the second rigid extension of the at least one kicking leg is perpendicularly attached to the third rigid extension;

wherein the second spring and the pivot joint are adapted to move the second rigid extension and the third rigid extension of the at least one kicking leg upwards and downwards relative to the first rigid extension during rotation of the kicking leg, via the ball bearing, around the third or fourth rod in response to a hit from a user of the boxing or sparring device;

wherein the second spring and the pivot joint are adapted to move the second rigid extension and the third rigid extension of the at least one kicking leg from side to side relative to the first rigid extension during rotation of the kicking leg, via the ball bearing, around the third or fourth rod in response to the hit from the user of the boxing or sparring device;

one or more boxing arms;

wherein the one or more boxing arms comprise a rigid arm extension that is attached to the fourth rod via a ball bearing;

one or more boxing bags; and wherein the one or more boxing bags comprise a top end, a bottom end, a body, and an internal opening that can be accessed from the top and bottom ends, and wherein said internal opening is configured to surround at least a portion of the fourth rod.

2. The boxing or sparring device of claim 1, wherein the one or more boxing arms are covered by a padding.

3. The boxing or sparring device of claim 1, wherein the one or more boxing bags are secured to the fourth rod via a combination of first and second mounting plates and first and second retaining rings.

4. The boxing or sparring device of claim 1, wherein the second, third and fourth rods include one or more holes configured to receive the fixation screw.

5. The boxing or sparring device of claim 1, wherein the first rigid extension of the at least one kicking leg is covered by a first padding, the second rigid extension of the at least one kicking leg is covered by a second padding, and the third rigid extension of the at least one kicking leg is covered by a third padding.

6. The boxing or sparring device of claim 1, further comprising one or more wheels connected to the flat portion of the free-standing base.

7. A boxing or sparring device, comprising:

a free-standing base;

a first rod, a second rod, a third rod and a fourth rod;

wherein each of the first rod, the second rod, the third rod, and the fourth rod comprises a diameter;

a first spring comprising a first end and a second end;

wherein the free-standing base comprises a flat portion and a supporting receptacle with an opening configured to receive a first end of the first rod;

wherein the supporting receptacle comprises a diameter that is larger than the diameter of the first rod;

wherein the diameter of the second rod is larger than the diameter of the third rod;

wherein the diameter of the third rod is larger than a diameter of the fourth rod;

wherein the first spring comprises a diameter that is larger than the diameter of the first rod and the diameter of the second rod;

wherein one end of the supporting receptacle is perpendicularly attached to the flat portion of the base;

wherein the first end of the first rod is secured to the supporting receptacle via a fixation clamp;

wherein a second end of the first rod is inserted into the first end of the first spring and welded therein;

wherein a first end of the second rod is inserted into the second end of the first spring and welded therein;

wherein a first end of the third rod is inserted into a second end of the second rod;

wherein a first end of the fourth rod is inserted into a second end of the third rod;

wherein the third rod and the fourth rod are secured to the second rod via a fixation screw that radially crosses the second, third and fourth rods;

one or more boxing arms attached to the fourth rod via a ball bearing; and one or more boxing bags wherein the one or more boxing bags comprise a top end, a bottom end, a body, and an internal opening that can be accessed from the top and bottom ends, and wherein said internal opening is configured to surround at least a portion of the fourth rod.

* * * * *